US006230782B1

(12) United States Patent
Reichert

(10) Patent No.: US 6,230,782 B1
(45) **Date of Patent: *May 15, 2001**

(54) SHUTTER BOX FOR A WINDOW OR DOOR

(75) Inventor: Rainer Reichert, Bastheim (DE)

(73) Assignee: Schüco International KG, Bielefeld (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/918,245

(22) Filed: Aug. 25, 1997

(30) Foreign Application Priority Data

Feb. 14, 1997 (DE) ..... 297 02 516

(51) Int. Cl.[7] ..... E04F 10/06
(52) U.S. Cl. ..... 160/32; 160/23.1
(58) Field of Search ..... 49/74.1; 160/38, 160/39, 19, 23.1, 26, 32, 33

(56) References Cited

U.S. PATENT DOCUMENTS 2,428,644 * 10/1947 Zega ..... 160/23.1
3,722,571 * 3/1973 Knight et al. ..... 160/23.1
4,168,734 * 9/1979 Holmqvist et al. ..... 160/23.1
4,282,909 * 8/1981 Teno ..... 160/23.1
4,399,855 * 8/1983 Volfson ..... 160/23.1
4,611,848 * 9/1986 Romano ..... 160/23.1
4,662,038 * 5/1987 Walker ..... 24/460
4,883,109 * 11/1989 Sonderby ..... 160/23.1
4,947,762 * 8/1990 Perzl et al. ..... 160/23.1
5,040,843 * 8/1991 Russell et al. ..... 160/23.1
5,191,735 * 3/1993 Ross ..... 49/74.1
5,371,925 * 12/1994 Sawatsky ..... 24/460
5,460,216 * 10/1995 Hirao et al. ..... 160/23.1
5,613,282 * 3/1997 Deddens, Sr. et al. ..... 24/460

* cited by examiner

*Primary Examiner*—Jerry Redman
*Assistant Examiner*—Curtis A. Cohen
(74) *Attorney, Agent, or Firm*—Henry M. Feiereisen

(57) ABSTRACT

A shutter box for a door having a leaf includes a top cover, and an angle section bar having an outward and upward leading wall portion and a substantially vertical portion extending to the top cover. The leading wall portion is connected directly to the vertical portion and forms an oblique angle therebetween. The shutter box is assembled utilizing exclusively engageable snaps and attachable to the door by engageable snaps, with the leading wall portion of the angle section bar arranged substantially parallel to an obliquely extending portion of the leaf of the door, when the door is in a closed state.

20 Claims, 2 Drawing Sheets

SHUTTER BOX FOR A WINDOW OR DOOR

BACKGROUND OF THE INVENTION

1. Field of the Invention

The present invention relates to a shutter box for a window or door, the bottom region of which simultaneously takes the form of a top transverse spar of the fixed frame, against which the casement of the window or leaf of the door strikes, and the transverse spar simultaneously takes the form of an angle section bar with an obliquely outward and upward leading wall portion and an extensively vertical web extending up to the top cover of the shutter box.

2. Description of the Related Art

Such a shutter box is known from German Utility Model DE 92 01 336 U1. To manufacture said known shutter box, individual sections are produced which then have to be assembled by means of screw connections to form the shutter box. A plastic material is frequently used to manufacture the individual sections; the individual sections made of said material are connected to one another by screws made of metal. This is expensive and laborious. Such a shutter box is however a mass-produced product which is manufactured under corresponding time pressure, which leads to the screw connections also being produced under time pressure. The result is that often incorrectly fitting screw connections and accordingly incorrectly fitting shutter boxes are produced or, because of the extreme time pressure, the points provided in the plastic material for receiving the metal screws are damaged with the result that the individual section may no longer be used.

In order to eliminate the described problems, the object of the present invention is to develop the shutter box in such a way that the risk of damage to the individual sections is avoided and the shutter box may be manufactured quickly, easily and inexpensively.

SUMMARY OF THE INVENTION

According to the invention, the shutter box to said end is formed by a plurality of individual sections which are connectable by means of separable plug-in connections to form the shutter box. Said plug-in connections are easily put together by hand during assembly. Damage to the individual sections is therefore ruled out. Since, in principle, no tools of any kind are needed for assembly, assembly is very easy and hence inexpensive.

In an advantageous embodiment, a vertically extending web may be introduced between the angle section bar and the top cover and may be connected likewise by means of separable plug-in connections to the angle section bar and the top cover. As a result, it is possible to create a shutter box of variable height, this being advantageous particularly when armoured shutters of differing length and hence take-up shafts of differing diameter are to be accommodated in the same shutter boxes. In such cases, it is possible by simply inserting a vertical web and fitting a suitable side wall to adapt the size of the shutter box without any further modifications being required.

Further variation possibilities arise when the angle section bar itself is also composed of individual sections.

The individual sections themselves at least in areas preferably take the form of hollow sections, resulting particularly in a high rigidity of the sections and a high strength of the shutter box as a whole.

According to an embodiment, the individual sections at least in portions are provided with grooves and tongues. It is therefore possible to achieve a particularly simple and durable plug-in connection of the individual section parts because, in each case, all that is required is to arrange one section part with a tongue adjacent to a corresponding groove of a second section part which is to be connected to the first section part and then press the two section parts together. The tongue preferably takes the form of an elastically deformable hollow section.

According to a further refinement, the individual sections at least in portions are provided with elastically spreadable, hook-like projections which are movable so as to engage, for example, in a latching, releasable manner into recesses in the respective adjacent individual section, which are substantially complementary in shape and/or function thereto, so as to establish the plug-in connection.

A particularly strong and stable plug-in connection arises when the grooves and tongues and/or the hook-like projections and the recesses complementary in shape and/or function thereto extend substantially continuously over the entire length of the individual sections because then, in contrast particularly to a punctiform screw connection, the entire section length or the entire length of the shutter box is used for a line-contact connection and a virtually tight connection of the individual sections is achieved without local vaulting.

The individual sections may take the form of extruded sections, especially of plastic material. In said case, the elements needed to produce the plug-in connection, such as, for example, grooves, tongues, projections and the like, may easily be formed integrally on the sections.

For further increasing the strength of the shutter box or the rigidity of the individual sections, according to a further embodiment reinforcing or stabilizing elements may be disposed in the individual sections. These may be, for example, inlaid rods or strips made of metal or plastic material.

BRIEF DESCRIPTION OF THE DRAWINGS

There follows a detailed description of the invention with reference to drawings which merely show embodiments. The drawings show.

DETAILED DESCRIPTION OF A PREFERRED EMBODIMENT

Figure 1:
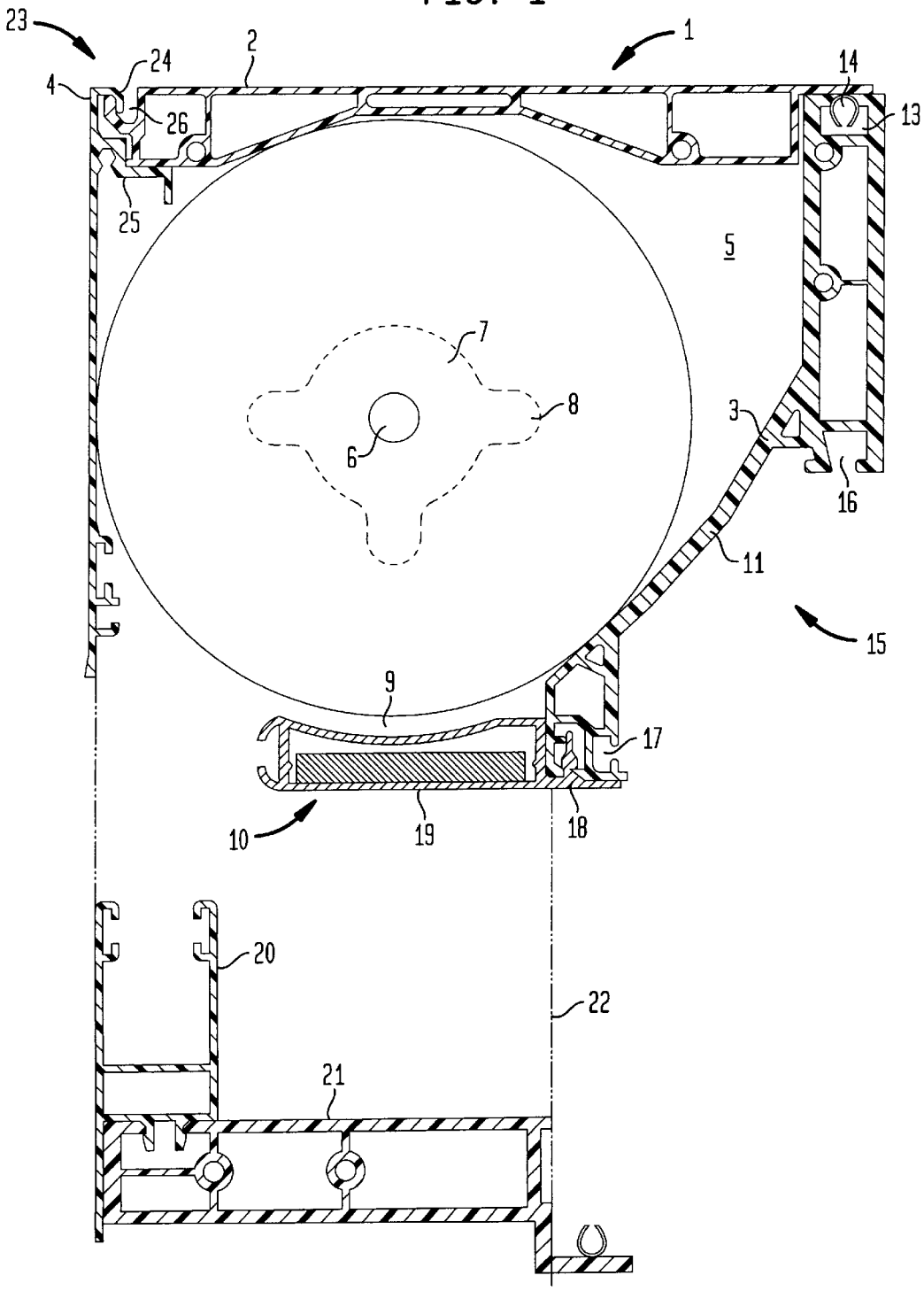
FIG. 1 is a diagrammatic, part-sectional view of a first embodiment of a shutter box according to the invention.

In FIG. 1, the reference character 1 quite generally denotes a shutter box having a top part or top cover 2, an angle section bar 3, an outer panel 4 and a side wall 5.

Inside the shutter box 1, an armoured shutter (not shown) is wound on a centrally provided take-up shaft 6, the take-up shaft being supported by two bearing blocks 7 which are fastened by the diagrammatically illustrated fastening means 8 to the shutter box.

Provided in the region below the take-up shaft is an opening 9 which may be made accessible for repair or maintenance purposes by removal of the plate 10 which is fastened to the angle section bar 3.

The angle section bar 3 closes off the rear of the shutter box 1 and simultaneously forms the top transverse spar of a fixed frame (not shown) of the window.

The angle section bar 3 has a connection to the side parts 5 (only one of which is shown in FIG. 1) of the shutter box 1.

As may easily be seen in FIG. 1, the angle section bar 3 has an obliquely outward and upward extending wall portion 11, adjoining which is a substantially vertical region.

At its top side, the angle section bar has a groove 13 extending over the entire length, into which a tongue 14 of the top cover 2 likewise extending over the entire length of the top cover 2 may be introduced. Thus, by intermating, top cover and angle section bar may be connected to one another easily without a tool. The plug-in connection shown in FIG. 1, comprising the tongue 14 and the groove 13, is notable for the fact that the tongue 14 is formed by an elastically deformable hollow section which, upon insertion into the groove 13, is elastically compressed. After insertion of the tongue 14 into the groove 13, the tongue 14 substantially readopts its undeformed initial configuration, thereby producing a keyed connection between the tongue 14 and the groove 13.

All of the individual sections needed to form the shutter box 1 have such connecting elements which are connectable to one another without a tool so that, unlike the known shutter box, it is no longer necessary to use screws to connect the individual sections. As a result, quick, trouble-proof and inexpensive assembly of the shutter box is possible.

So, for example, the plate 10, which in the present embodiment is made of aluminum, is also provided with such a plug-in connecting element which may be connected to a complementary connecting element of the angle section bar 3. Although said joint is also a tongue-and-groove joint, unlike the joint described above the tongue does not comprise a hollow section so that in said case, when the plug-in connection is established, an elastic spreading of the groove section of the angle section bar occurs.

The top cover 2 in the region of its connection to the outer panel 4 also has such a connecting element, which is connectable without a tool to a corresponding connecting element of the outer panel 4. Said plug-in connection thus formed does not take the form of a tongue-and-groove joint. Rather, the outer panel 4 in the region of its connecting edge 23 is provided with, in each case, one hook-like projection 24, 25, the projection 24 being movable so as to engage into a recess 26 of the top cover 2 which is complementary in shape and/or function thereto. By means of the second projection 25, a flat application against the underside of the top cover 2 is effected.

16 and 17 denote section portions accommodating sealing elements which are inserted into the angle section bar 3 of the shutter box 1. Similar sealing elements are also to be found in other sections for forming the fixed window frame.

With the shutter box according to the invention, which may be used both at a window and at a door, a considerable amount of time may be saved when assembling the shutter box because all that is required is to intermate the individual sections. The angle section bar 3, because of the obliquely outward and upward extending wall portion 11, forms a cavity 15 into which the top transverse spar 27 (cf. FIG. 2) of the casement of the window may engage. In the closed state of the window, the obliquely extending portion of the casement of the window runs substantially parallel to the obliquely extending wall portion 11 of the angle section bar 3. It is therefore clear that, with the shutter box 1 according to the invention, a compact combination of shutter box and window is possible so that the casement may engage substantially into the region below the obliquely extending wall portion 11 and is not applied, say, at the level of the surface of the vertical region of the angle section bar 3.

The individual sections mainly take the form of extruded sections. In the illustrated embodiment, the angle section bar 3 is integrally formed as an extruded section; however, it is also possible to form the angle section bar 3 from a plurality of individual sections which are provided with suitable plug-in connecting elements so that they may be connected to form the angle section bar 3.

FIG. 1 makes it clear that it is possible, instead of the plate 10 for closing the inspection opening 9, to use a hollow section (e.g. made of aluminum) and connect said hollow section by a separable plug-in connection 18 to the angle section bar 3. In order to increase the rigidity of the hollow section, a reinforcement, e.g. in the form of a flat steel bar 19, may be provided inside the hollow section.

FIG. 1 of the drawings finally shows, in the region of the bottom half of the drawing in a view rotated through 90°, a shutter guide 20 which is used to accommodate the armoured shutter in the lowered state. The shutter guide 20 is in turn connected by a separable plug-in connection to an intrados section 21, which is used to align the shutter guide 20 flush with the window frame edge 22. As is easily apparent, the intrados section 21 may also be connected by a tongue 14 to a further section (not shown).

Although the separable plug-in connections have been described above as tongue-and-groove joints, it is clear that here it is alternatively possible to use different connecting elements which may be brought into operational connection with one another without the aid of a tool.

Figure 2:
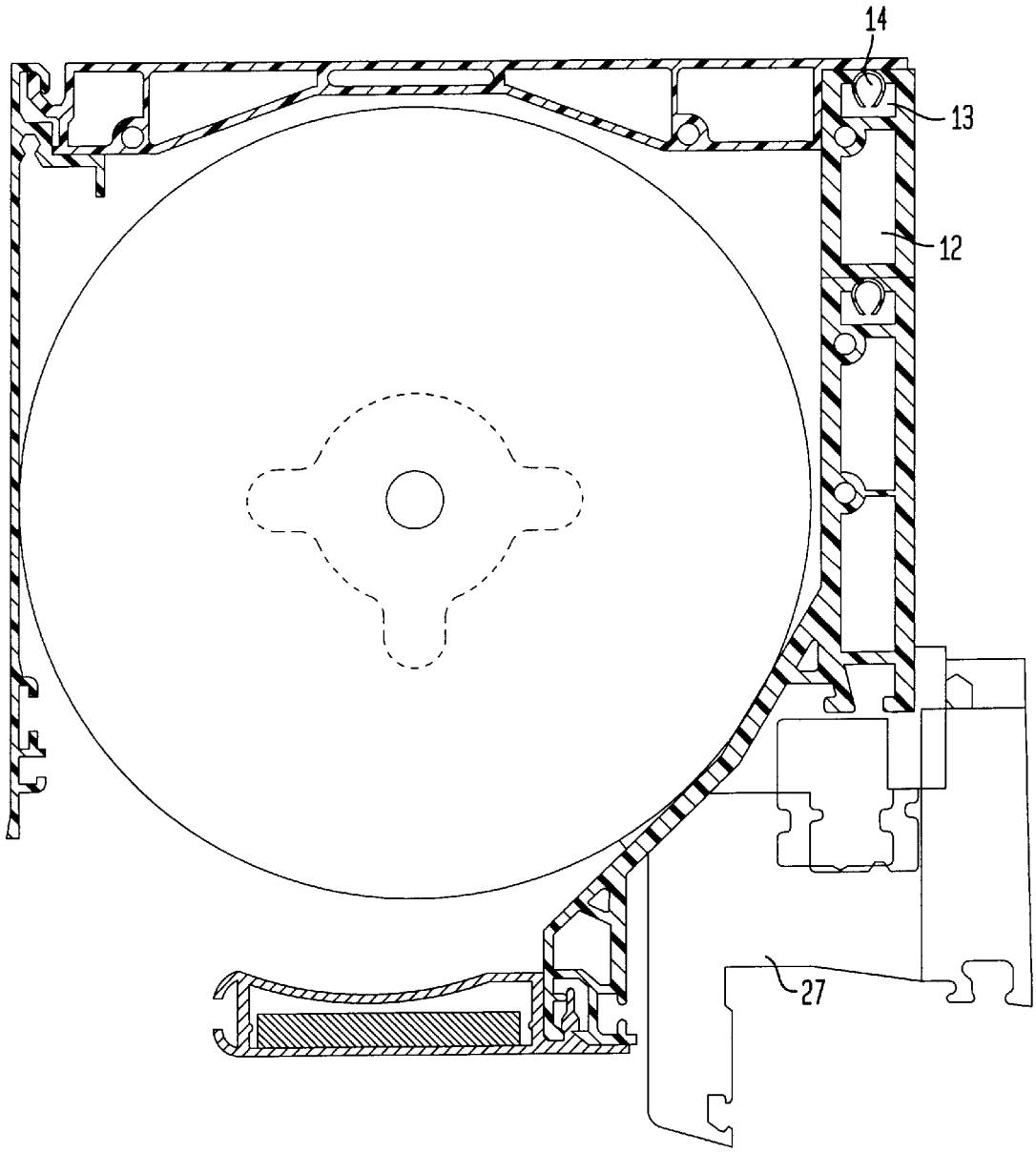
FIG. 2 is a shutter box supplemented by an additional web.

Compared to the embodiment shown in FIG. 1, in the embodiment shown in FIG. 2 an additional, vertically extending web 12 is introduced between the angle section bar 3 and the top cover 2. Particularly when the embodiment according to FIG. 1 is compared with that according to FIG. 2 it is clear that the additional web section allows the installation of take-up shafts of larger diameter without any further modifications of the shutter box having to be carried out for said purpose. The plug-in connection of the web 12 is compatible with the plug-in connecting elements of the top cover 2 and angle section bar 3. The web may therefore be inserted without difficulty between top cover and angle section bar.

What is claimed is:

1. An assembly including a shutter box, a shutter, and a door having a leaf, the assembly comprising:

a top cover; and an angle section bar having an outward and upward leading wall portion and a substantially vertical portion extending to the top cover, the leading wall portion is connected directly to the vertical portion and forms an oblique angle therebetween;

the shutter box being assembled utilizing exclusively engageable snaps and is attachable to the door by said engageable snaps, the leading wall portion of the angle section bar having an outer surface arranged substantially parallel to an obliquely extending surface of the leaf of the door, when the door is in a closed state.

2. An assembly including a shutter box having a shutter mounted therein and a door leaf mounted adjacent said shutter box, the assembly comprising:

a cover having a first engageable cover end and a second engageable cover end;

a wall section including an angled portion and a substantially vertical portion, said wall section having a first engageable wall section end and a second engageable wall section end, the angled portion is connected directly to the vertical portion and forms an oblique angle therebetween;

a front panel including an engageable top front panel end and an engageable bottom front panel end; and an inspection plate including an engageable plate end;

said engageable first cover end and said engageable top front panel end are engaged to form a unit; said engageable second cover end and said first engageable wall section end are engaged to form a unit;

said second engageable wall end section and said engageable plate end are engaged; said cover, said wall section, said front panel and said inspection plate form said shutter box assembly, the angled portion of the wall section having an outer surface substantially parallel to an obliquely extending surface of the leaf of the door, when the door is in a closed state.

3. The shutter box assembly according to claim 2, wherein said wall section is expandable by an extension section having an engageable top end and an engageable bottom end and wherein the top end engages with the second engageable cover end.

4. The shutter box assembly according to claim 2, wherein said cover, said wall section, said front panel and said inspection plate include hollow portions.

5. The shutter box assembly according to claim 4, wherein said first engageable cover end includes a recess; and wherein said engageable top front panel end includes a moveable hook projection for engaging into said recess.

6. The shutter box assembly according to claim 5, wherein said recess extends across the first engageable cover end.

7. The shutter box assembly according to claim 2, wherein said first and second engageable cover ends, said first and second engageable wall section ends, said engageable top front panel end, said engageable bottom front panel end, and said engageable plate end are connected together using tongue and groove snaps.

8. The shutter box assembly according to claim 7, wherein the tongue and groove snaps include a hollow and elastically deformable tongue portion.

9. The shutter box assembly according to claim 2, wherein said cover, said wall section, said front panel, and inspection plate are made from extruded plastic.

10. The shutter box assembly according to claim 9, wherein the inspection plate includes a reinforcement element.

11. An assembly including a shutter box, a shutter, and a window having a casement, the assembly comprising:

an angle section bar having an outward and upward leading wall portion and a substantially vertical region extending to the top cover, the reading wall portion is connected directly to the vertical portion and forms an oblique angle therebetween;

the shutter box being assembled utilizing exclusively engageable snaps and is attachable to the window by said engageable snaps, the leading wall portion of the angle section bar having an outer surface arranged substantially parallel to an obliquely extending surface of the casement of the window, when the window is in a closed state.

12. An assembly including a shutter box having a shutter mounted therein and a window mounted adjacent said shutter box, the assembly comprising:

a cover having a first engageable cover end and a second engageable cover end;

a wall section including an angled portion and a substantially vertical portion, said wall section having a first engageable wall section end and a second engageable wall section end, the angled portion is connected directly to the vertical portion and forms an oblique angle therebetween;

a front panel including an engageable top front panel end and an engageable bottom front panel end; and an inspection plate including an engageable plate end;

said engageable first cover end and said engageable top front panel end are engaged to form a unit; said engageable second cover end and said first engageable wall section end are engaged to form a unit;

said second engageable wall end section and said engageable plate end are engaged; said cover, said wall section, said front panel and said inspection plate form said shutter box assembly, the angled portion of the wall section having an outer surface arranged substantially parallel to an obliquely extending surface of the casement of the window, when the window is in a closed state.

13. The shutter box assembly according to claim 12, wherein said wall section is expandable by an extension section having an engageable top end and an engageable bottom end and wherein the top end engages with the second engageable cover end.

14. The shutter box assembly according to claim 12, wherein said cover, said wall section, said front panel and said inspection plate include hollow portions.

15. The shutter box assembly according to claim 14, wherein said first engageable cover end includes a recess; and wherein said engageable top front panel end includes a moveable hook projection for engaging into said recess.

16. The shutter box assembly according to claim 15, wherein said recess extends across the first engageable cover end.

17. The shutter box assembly according to claim 12, wherein said first and second engageable cover ends, said first and second engageable wall section ends, said engageable top front panel end, said engageable bottom front panel end, and said engageable plate end are connected together using tongue and groove snaps.

18. The shutter box assembly according to claim 17, wherein the tongue and groove snaps include hollow and elastically deformable tongue portions.

19. The shutter box assembly according to claim 12, wherein said cover, said wall section, said front panel, and inspection plate are made from extruded plastic.

20. The shutter box assembly according to claim 19, wherein the inspection plate includes a reinforcement element.

* * * * *